US005584081A

United States Patent [19]

Ouelette

[11] Patent Number: 5,584,081

[45] Date of Patent: Dec. 17, 1996

[54] ADJUSTABLE LIFTING APPARATUS FOR A SPA

[76] Inventor: Roger J. Ouelette, 5235 S. Kyrene, Ste. 24, Tempe, Ariz. 85283

[21] Appl. No.: 421,437

[22] Filed: Apr. 12, 1995

[51] Int. Cl.[6] ..... E04H 4/08

[52] U.S. Cl. ..... 4/498

[58] Field of Search ..... 4/498, 494

[56] References Cited

U.S. PATENT DOCUMENTS

| | | | |
|---|---|---|---|
| 4,853,985 | 8/1989 | Perry | 4/498 |
| 5,048,153 | 9/1991 | Wall et al. | 4/498 X |
| 5,131,102 | 7/1992 | Salley et al. | 4/498 |

*Primary Examiner*—Robert M. Fetsuga
*Attorney, Agent, or Firm*—Harris Beach & Wilcox, LLP

[57] ABSTRACT

A lifting frame for a hinged spa cover having a pair of adjustable lifting arms pivotally mounted adjacent side walls of a spa. A U-shaped foot actuated lever is connected to the lifting arms with the base of the lever extended across one end wall of the spa. The upper part of the arms are equipped with one or more supports that are adjacent to and parallel with the cover hinge whereby the cover is foldable over the support or supports when the lifting arms are in a first position. The foot lever is elevated when the lifting arms are in the first position and depressing the lever cause the arms to be rotated to a second position whereby the folded cover is supported in a vertical position adjacent one end wall of the spa.

6 Claims, 9 Drawing Sheets

48
49
50
55
52
51
37
35
38
33
30
45
44
31
29
32
36
26
25
θ

ADJUSTABLE LIFTING APPARATUS FOR A SPA

BACKGROUND OF THE INVENTION

This invention relates to a lifting mechanism for removing and replacing the cover of a spa.

The use of outdoor spas has become widespread, particularly in the regions of the country that enjoy generally warm weather. Most outdoor spas are equipped with covers which when closed, prevents debris, rain and the like from contaminating the tub water when the spa is not being utilized. The cover further serves to retain heat within the tub to help maintain the water at a desired temperature level. As a consequence, the spa covers tend to be relatively heavy and thus difficult to remove and replace over the tub.

Lifting devices have been developed to aid in the removal and replacement of these relatively heavy spa covers which can be operated with varying amounts of difficulty by one person. One such lifting device is disclosed in U.S. Pat. No. 5,131,102 to Salley et al. A pair of lifting arms are pivotally mounted along the back wall of a spa and the extended ends of the arms are, in turn, cojoined by a bridge arm that passes over the cover along the center hinge of the cover. To remove the cover, the two half sections of the cover are folded over the bridge arm and the lifting arm is then rotated upwardly and rearwardly to bring the cover to a raised position adjacent to the rear wall of the spa. Although this lifting mechanism works well in practice, the bridge arm tends to become angularly offset when the operator pulls on one or the other of the lifting arms. This in turn can produce excessive wear on the cover and misalignment of the cover. In addition, this lifting arm arrangement must provide only a limited amount of mechanical advantage to the operator.

Walls et al., U.S. Pat. No. 5,048,153, describes a similar lifting mechanism for a spa cover in which the extended ends of the lifting arms are securely attached to the opposed side walls of the spa cover using a hinge plate and pivot mechanism. The lifting arms are equipped with spring loaded struts which absorb the weight of the cover as it is rotated into an open position. Again, this type of lifting mechanism has a limited mechanical advantage and the hinge plate connections produce excessive wear on the cover. Lastly, this type of lifting mechanism does not have the adjustability such that it can be adapted for use in association with various sized spas.

SUMMARY OF THE INVENTION

It is therefore an object of the present invention to improve apparatus for removing and replacing relatively heavy spa covers.

A further object of the present invention is to provide a relatively light weight lifting device for a spa cover that is fully adjustable to fit various size spas.

A still further object of the present invention is to provide a lifting apparatus for a spa cover that is simple in construction and provides sufficient mechanical advantage so that it can be easily operated by one person to remove and replace a relatively heavy spa cover.

Another object of the present invention is to provide a lifting apparatus for a spa cover that has an easily accessible foot actuated lever that enables one person to operate the device.

These and other objects of the present invention are attained by a lifting frame for a spa cover that has two half sections cojoined by a hinge whereby the half sections are foldable one over the other, the lifting apparatus having a pair of pivots mounted either in opposed side walls of a spa or in the deck adjacent to the side walls. A lifting arm is redoubtable mounted in each pivot. In one form of this invention, a stub shaft is mounted in the upper part of each lifting arm and is rotatable by the arm from a first position adjacent to and parallel with the cover hinge and a second position clear of one end wall of the spa. In operation, the cover is folded over the stub shafts when the lifting arms are in a first position and then moved with the arms into the second position whereby the cover is supported in a vertical position adjacent to the one end wall. A W-shaped foot actuated lever is secured to the lifting arms with the base of the lever extending across the end wall of the spa. The base of the lever is in an elevated position when the lifting arms are in the first position so that a person attempting to rotate the arms can stand on the base to assist in the rotation of said arms. The elongated base also serves as a rest when the arms are in the second position. The length of each lifting arm is adjustable as is the width of the base whereby the frame can be adjusted to fit various size spas.

In another form of the invention, the extended upper ends of the lifting arms are cojoined by a horizontal beam over which the two half sections are folded when the arms are in a first position.

BRIEF DESCRIPTION OF THE DRAWINGS

For a better understanding of these and other objects of the present invention, reference will be made to the following detailed description of the invention which is to be read in association with the accompanying drawings, wherein.

DESCRIPTION OF THE INVENTION

Figure 1:
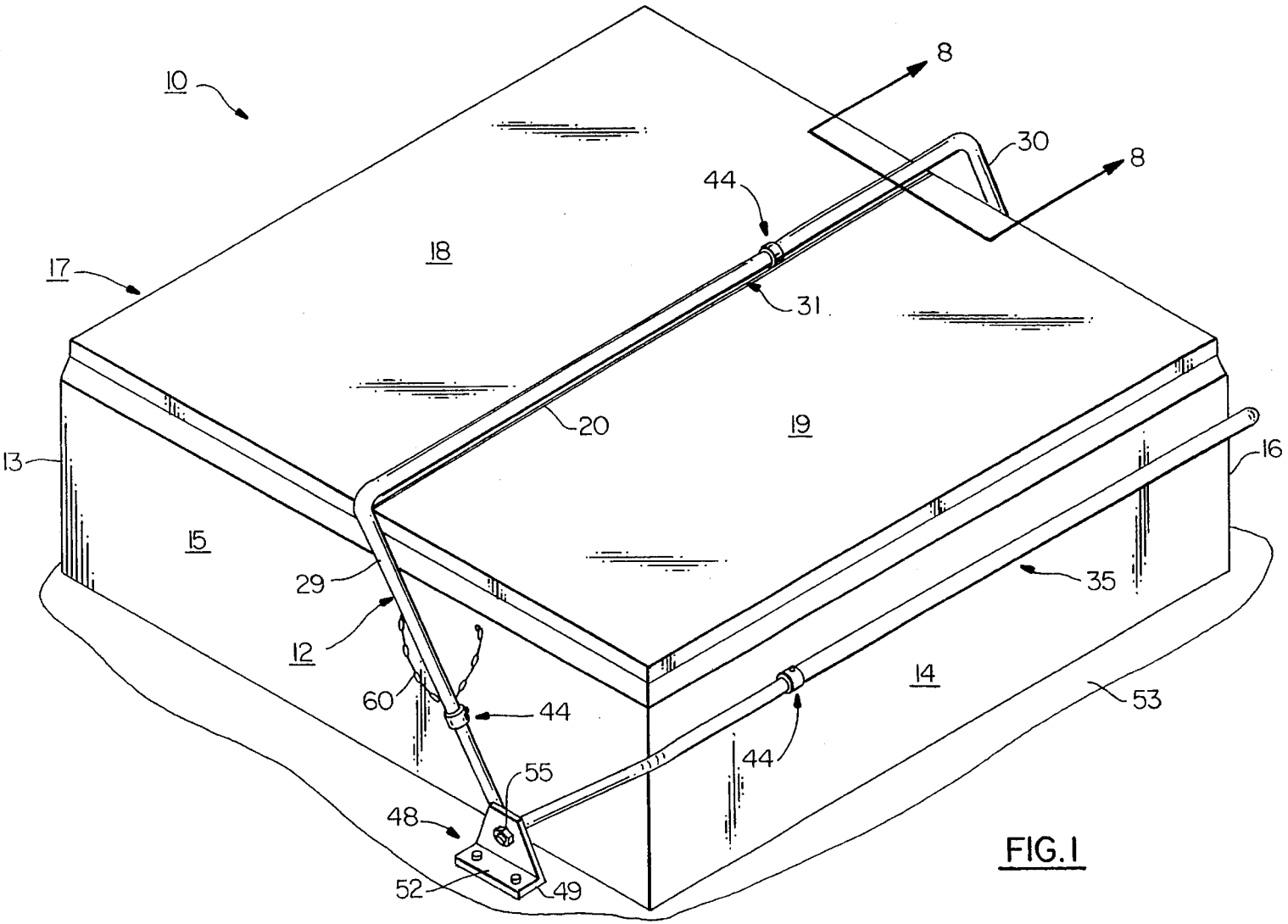
FIG. 1 is a perspective view showing a first embodiment of the present invention.

Referring initially to FIG. 1, there is illustrated an above-ground spa generally referenced 10, that includes a lifting frame 12 embodying the teachings of the present invention.

Although the spa can take one of a number of shapes, it is shown rectangular in form and includes a pair of end walls 13 and 14 and a pair of side walls 15 and 16. The top of the spa is closed by a removable cover 17. The cover is made in two half sections 18 and 19 that are joined together by means of a hinge 20 so that the half-sections can be folded one over the other. The cover contains a core section 21 that is enclosed within a high strength sheath 22 that forms part of the hinge between the two half-sections (see FIG. 8). Typically, the core section of the cover is relatively thick to provide sufficient insulation to hold heat within the tub when the cover is closed. As a consequence, the cover is typically relatively bulky and heavy and thus, difficult to remove and over the spa.

Lifting mechanisms have been devised for use in removing and replacing spa covers. For the most part, these devices have a large number of component parts which tend to weaken the overall structure of the device. Many of these prior art devices are difficult to operate by one person. In addition, these prior art devices, because of their complexity, cannot be readily adjusted for either height or width, and as a consequence, are poorly mated to the spa it services. This, in turn, can adversely effect the operation of the device and produce undue wear on the cover.

As shown in FIG. 1, the present lifting frame is simple in construction, yet fully adjustable in both height and width so that it can be easily mated to a spa for efficient operation during both removal and replacement of the cover. The lifting frame is further provided with an easily accessible foot actuated lever that provides a greatly enhanced mechanical advantage to the user so the cover can be easily removed and replaced by one person. The lifting mechanism is made of high strength light-weight tubing with the various tubular components telescoped one inside the other for adjustability without sacrificing strength. As will be explained below in greater detail, the telescoping joint between the mated tubular components is closed by a high strength split collar arrangement that not only prevents the telescope parts from shifting axially, but also prevents the parts from turning one inside the other.

Figures 3, 4, 5:
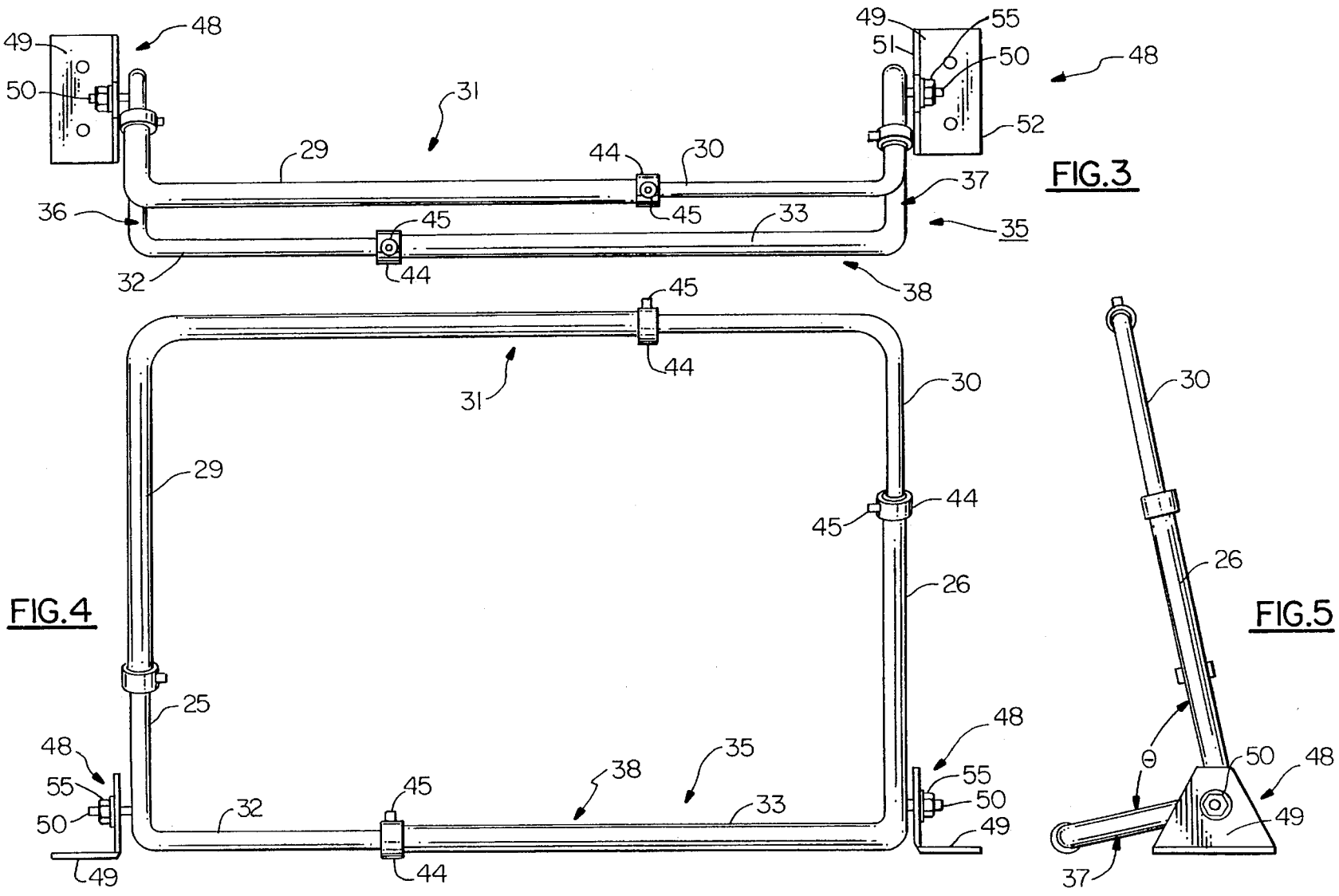
FIG. 3 is a top plan view of the lifting frame shown in FIG. 1.
FIG. 4 is a front elevation of the lifting frame shown in FIG. 3.
FIG. 5 is an end view of the lifting frame shown in FIG. 3.

The lifting frame includes a pair of lifting arms 25 and 26 that are joined in telescoping relationship at their upper or distal ends by a pair of L-shaped beam members 29 and 30 to create a cover support member 31. (FIGS. 3–5). The proximal or lower sections 32 and 33 of the two lifting arms are turned inwardly toward each other and telescoped together to form a U-shaped foot bracket generally referenced 35. The U-shaped bracket includes a pair of opposed legs 36 and 37 and a horizontally disposed base member 38. The two legs 36 and 37 of the bracket form an interior angle with the two lifting arms that is less than 90°.

A locking collar assembly is located at each of the telescoping joints. As illustrated at FIG. 4 for example, the assembly includes an annular locking collar 44 is slipped over the distal end portion of the lifting arm 26. One or more set screws 45 are threaded radially through the locking collar. Sufficient force is applied by the locking collar to prevent the telescoped member from sliding or turning in assembly, thus assuring a high strength joint which resists torque or bending when placed under load. The telescoping relationship and locking collar assemblies define means for adjusting the height and length of the lifting frame.

At each corner where the legs of the bracket 35 join the lifting arms, there is located a pivot unit 48. Each unit includes angle bracket 49 and a pivot pin 50 that is secured to frame at the corner and passes through an opening in the vertical plate 51 of the angle bracket. The horizontal plate 52 of angle bracket 49 may be secured to a deck 53 (FIG. 1) that surrounds the tub. Similarly, the angle bracket 49 may be replaced by a suitable bracket 54 (FIG. 13) that is secured to one of the tub side walls by any type of suitable fastener. The pivot pins are mounted within suitable bushings (not shown) within the angle brackets and secured in place by nuts 55.

Figure 8:
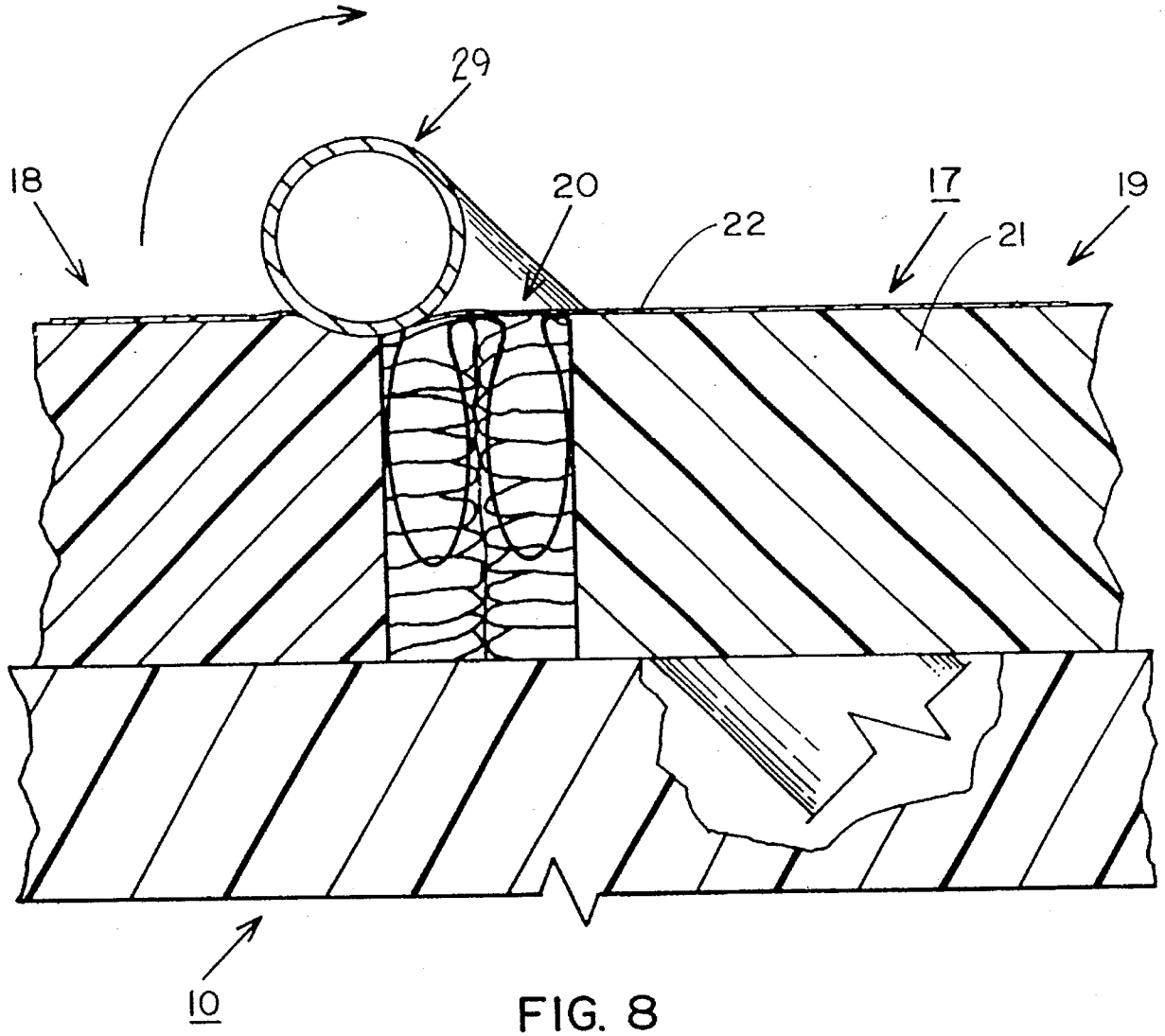
FIG. 8 is a section view taken along lines 8—8 in FIG. 1.
Figure 11:
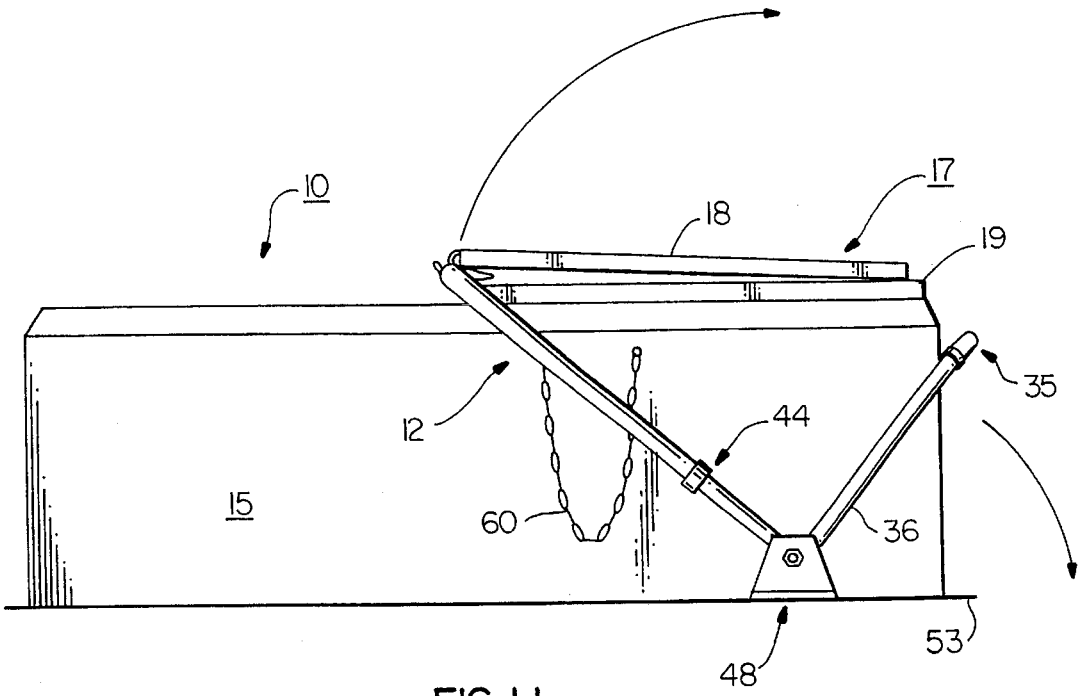
FIGS. 11 and 12 are side views of a spa showing the lifting frame is a first lowered position and a second raised position, respectively.
Figure 12:
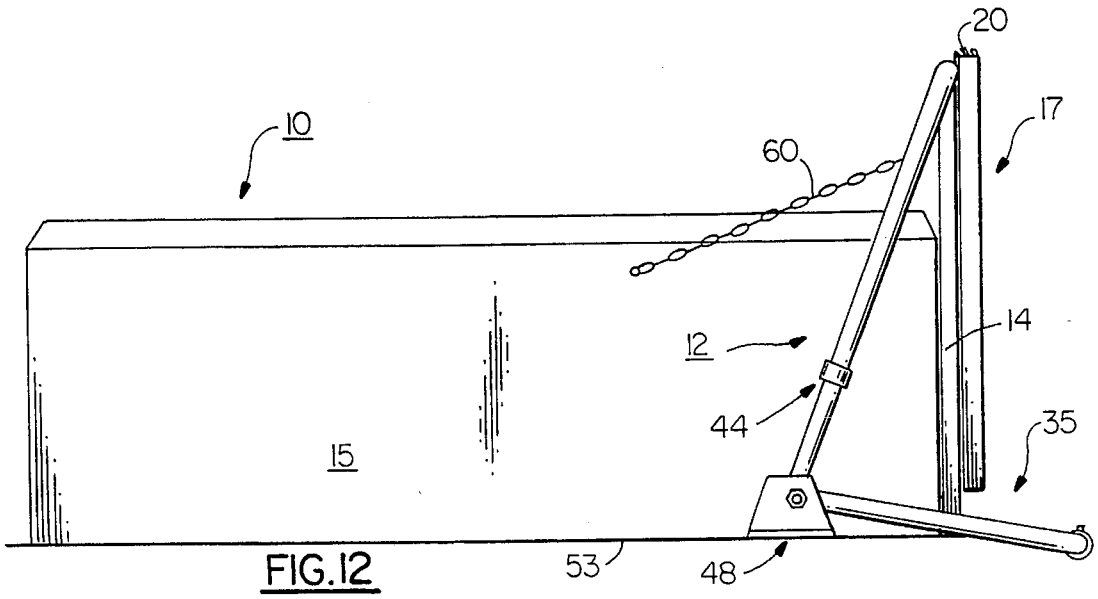

In assembly, the frame is adjusted for the width and height of the tub and the locking collars are then tightened down securely. The support member 31 is placed in parallel alignment with the hinge of the cover 19, as shown in FIG. 8, and the pivot units 48 then secured to the spa deck or alternatively, against the opposing side walls 15, 16 of the spa using any suitable type fasteners. To remove the cover, it is first folded over the lifting frame beam, as shown in FIG. 11. The foot bracket 35, at this time, is at an elevated position, as shown. To raise the cover, the operator simply grasps one of the lifting arms and steps upon the foot bracket 35. The foot bracket acts as a lever which, under the operator's weight, helps to swing the lifting arms and thus the cover upwardly to the raised position adjacent the end wall 14 of the tub as shown in FIG. 12. At this time, the foot bracket rests on the deck. Because the interior angle of the lifting frame corner's formed at the point of joinder between the lifting arms and the foot bracket is less than 90°, the frame, while resting upon the deck is tilted slightly rearwardly, thus allowing the cover to hang down vertically adjacent to the spa end wall 14. A safety chain 60 is attached between the spa and the adjacent lifting arm, which helps to support the frame in the raised position and prevent the frame from over-rotating. The cover is replaced over the tub by simply reversing the above described operation.

Figure 2:
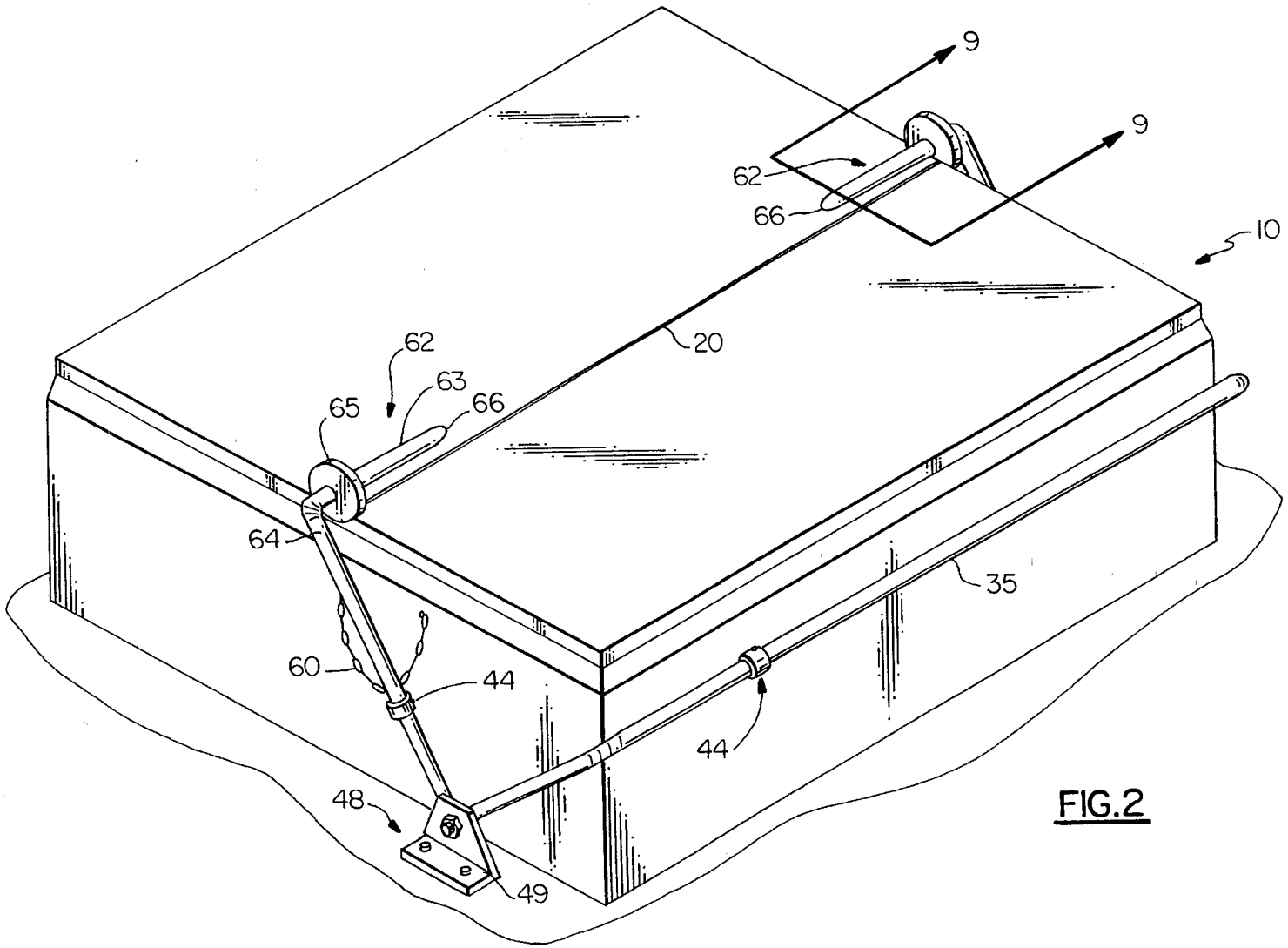
FIG. 2 is a perspective view showing a second embodiment of the present invention.
Figure 7:
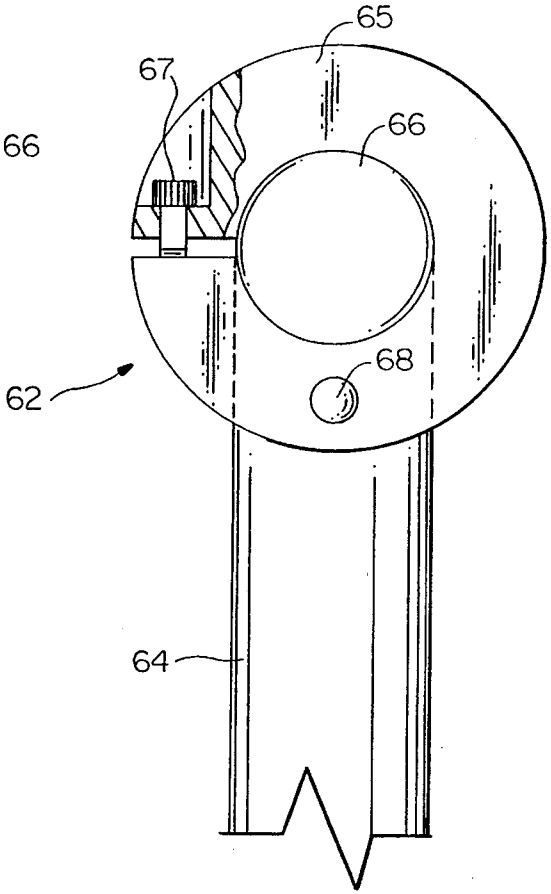
FIG. 7 is an end view of the beam shown in FIG. 6.
Figure 6:
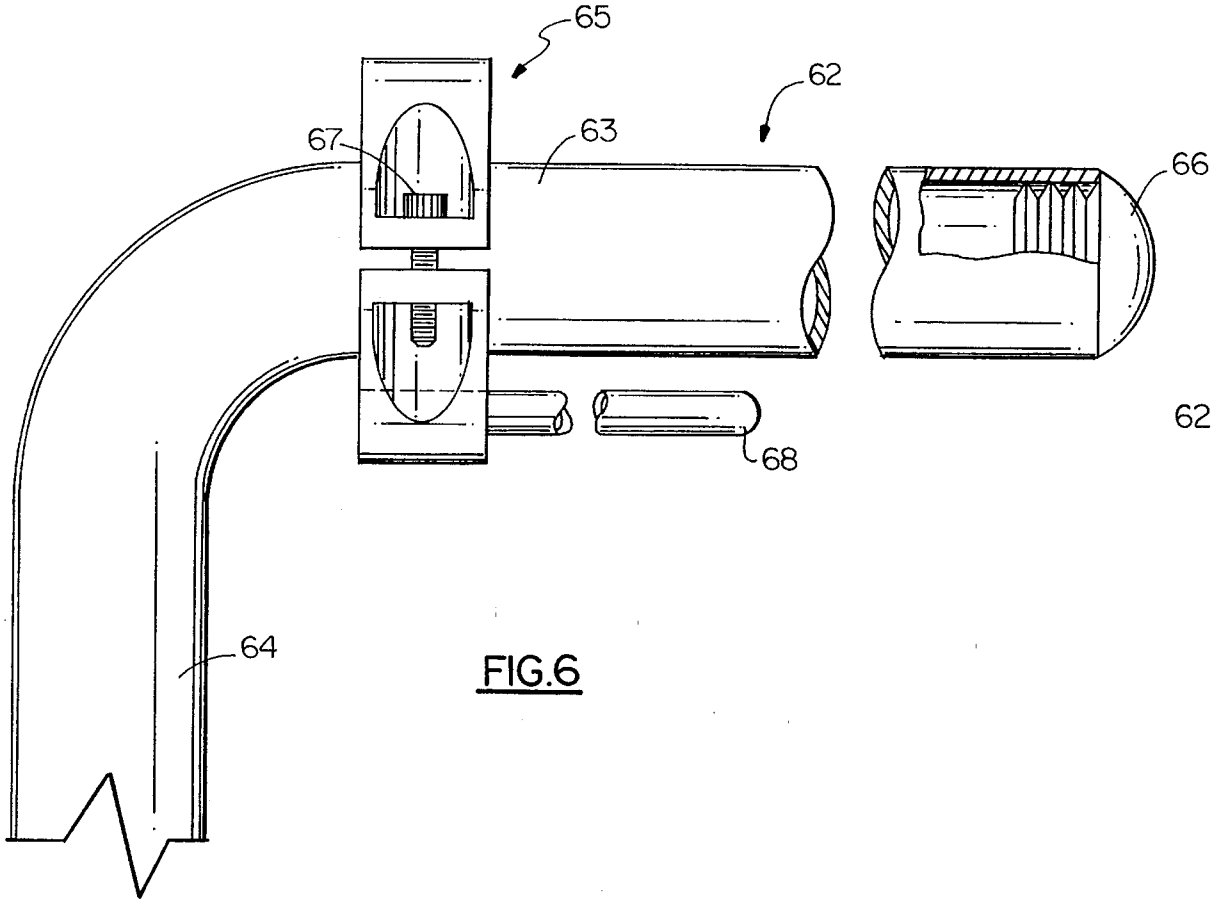
FIG. 6 is an enlarged side elevation of the beam utilized in the lifting frame shown in FIG. 2.

Turning now to FIGS. 2, 6 and 7 where like numbers related to like elements as described above, the lifting frame 12 has been slightly modified so that the support member 31 that extends across the cover along the hinge 20 is replaced by a pair of stub shaft units 62—62 that are positionable adjacent to and parallel with the cover hinge 20 when the lifting frame 12 is placed in the first lowered position. The stub shafts are L-shaped members having a horizontal leg 63 that extends some distance, preferably one or two feet over the cover and a vertical leg 64 that is telescoped into the adjacent lifting arm and adjustably locked in place by means of a retainer 44 of the type described above. The distal end of the leg 66 is closed by an end cap 66. A split collar face plate or hub 65 is mounted upon the horizontal leg of the unit and secured thereto by means of a set screw 67. An alignment pin 68 is stacked in the face plate and is positioned as shown beneath the horizontal leg 63 of the unit.

Figure 9:
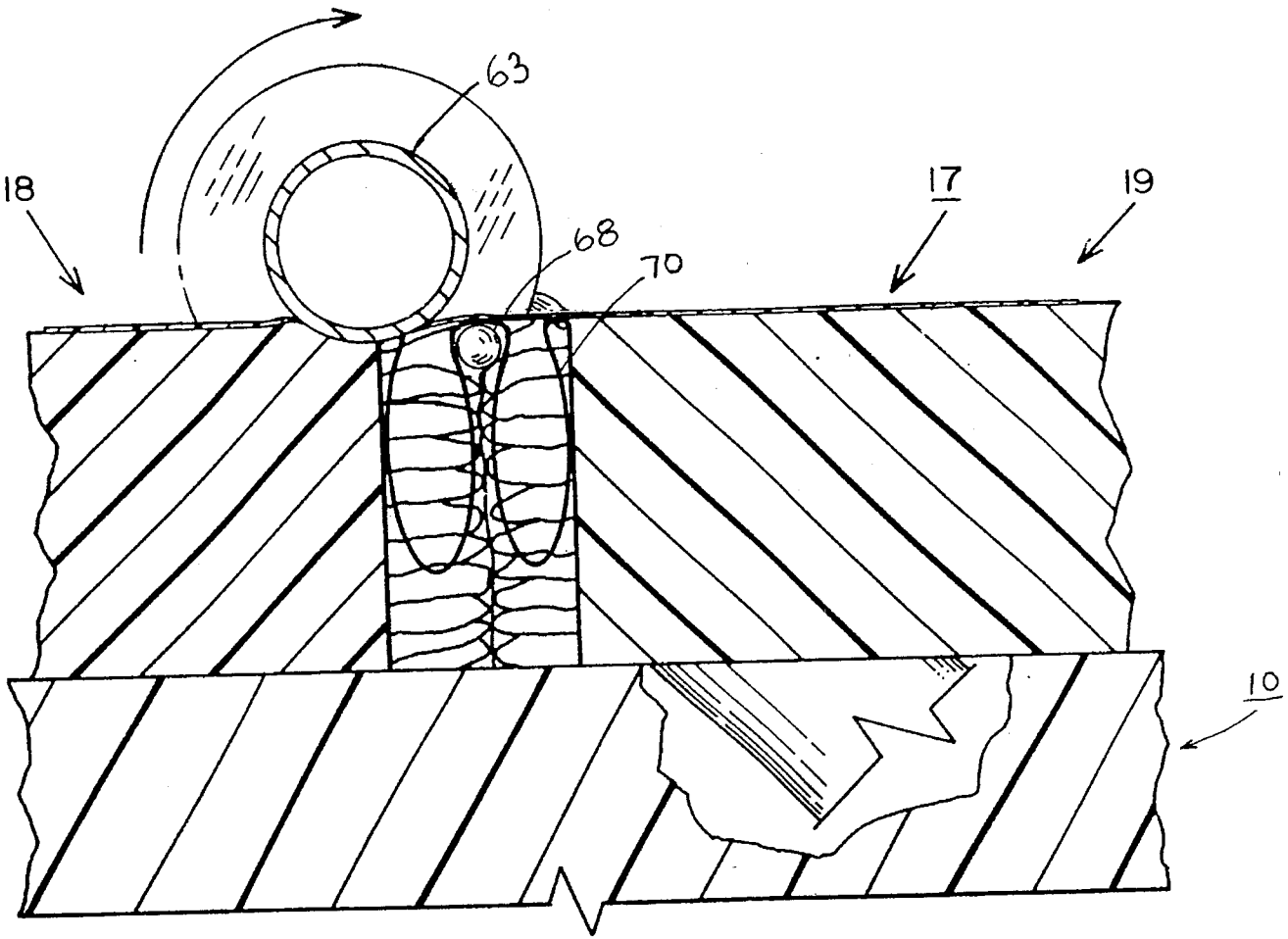
FIG. 9 is a sectional view taken along lines 9—9 in FIG. 2 showing the spa cover in an unfolded condition.
Figure 10:
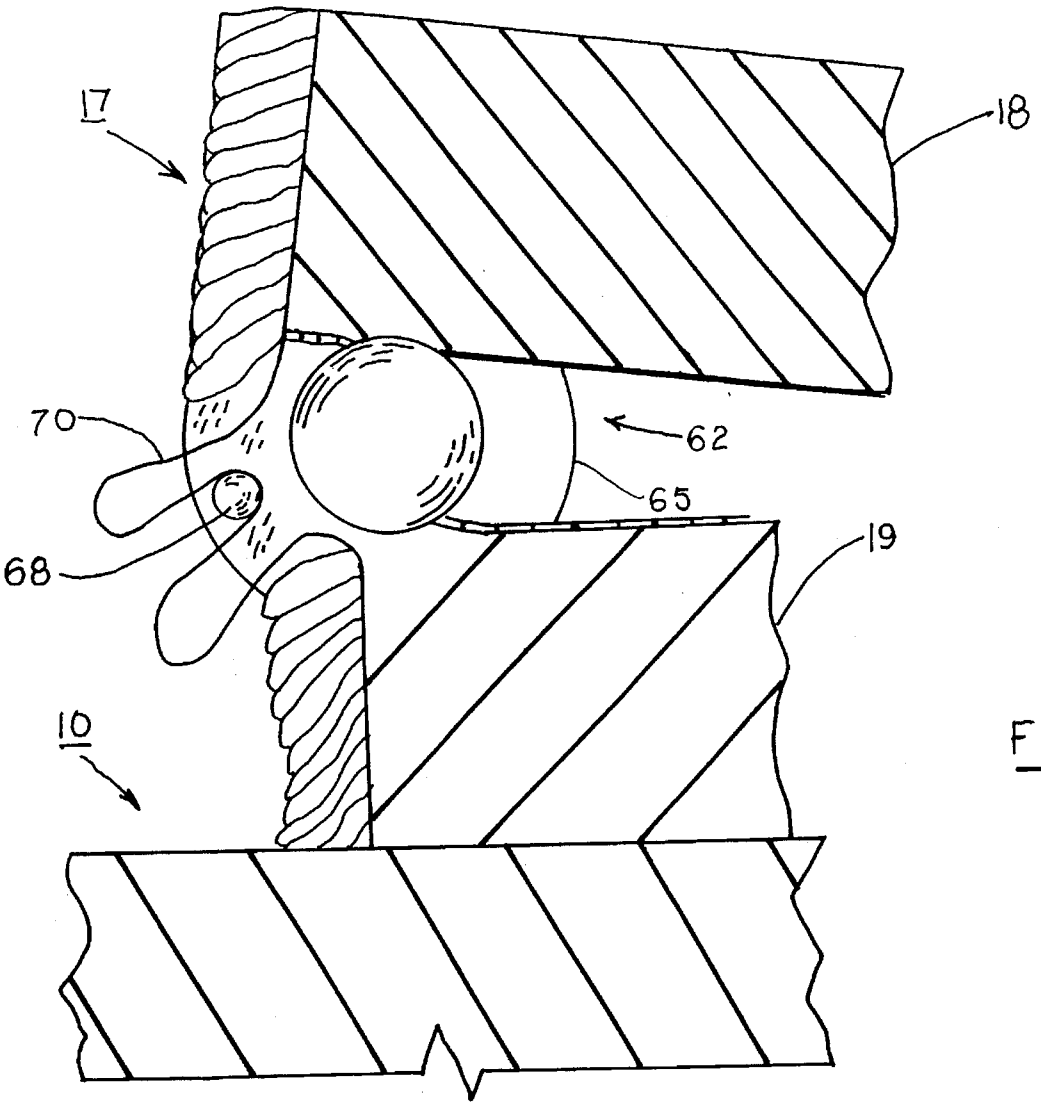
FIG. 10 is a sectional view similar to FIG. 9 showing the spa cover folded over the beam members.

Turning now to FIGS. 9 and 10, the horizontal leg 63 of the stub shaft assembly is arranged to rest on the top of the cover near or at the hinge when the cover is closed over the tub. At this time, the alignment pin 68 is passed into the hinge beneath the pleated section 70 of the hinge as shown in FIG. 9.

To remove the cover from the spa, one-half section 18 is folded over the two stub shaft assemblies as shown in FIGS. 10 and 11 and the frame is moved to the raised position as shown in FIG. 12 to support the cover adjacent to one end wall of the spa. Again, the cover is replaced by reversing the above noted operation.

The aligning pins act to prevent the lifting frame from being moved from the first lowered position into the second raised position when the cover is in an unfolded position. As can be seen, in the event the frame moves from the first position toward the second position with the cover unfolded, the safety dowel will engage the hinge pleat and thus prevent the frame from moving too far out of the first position.

Figure 13:
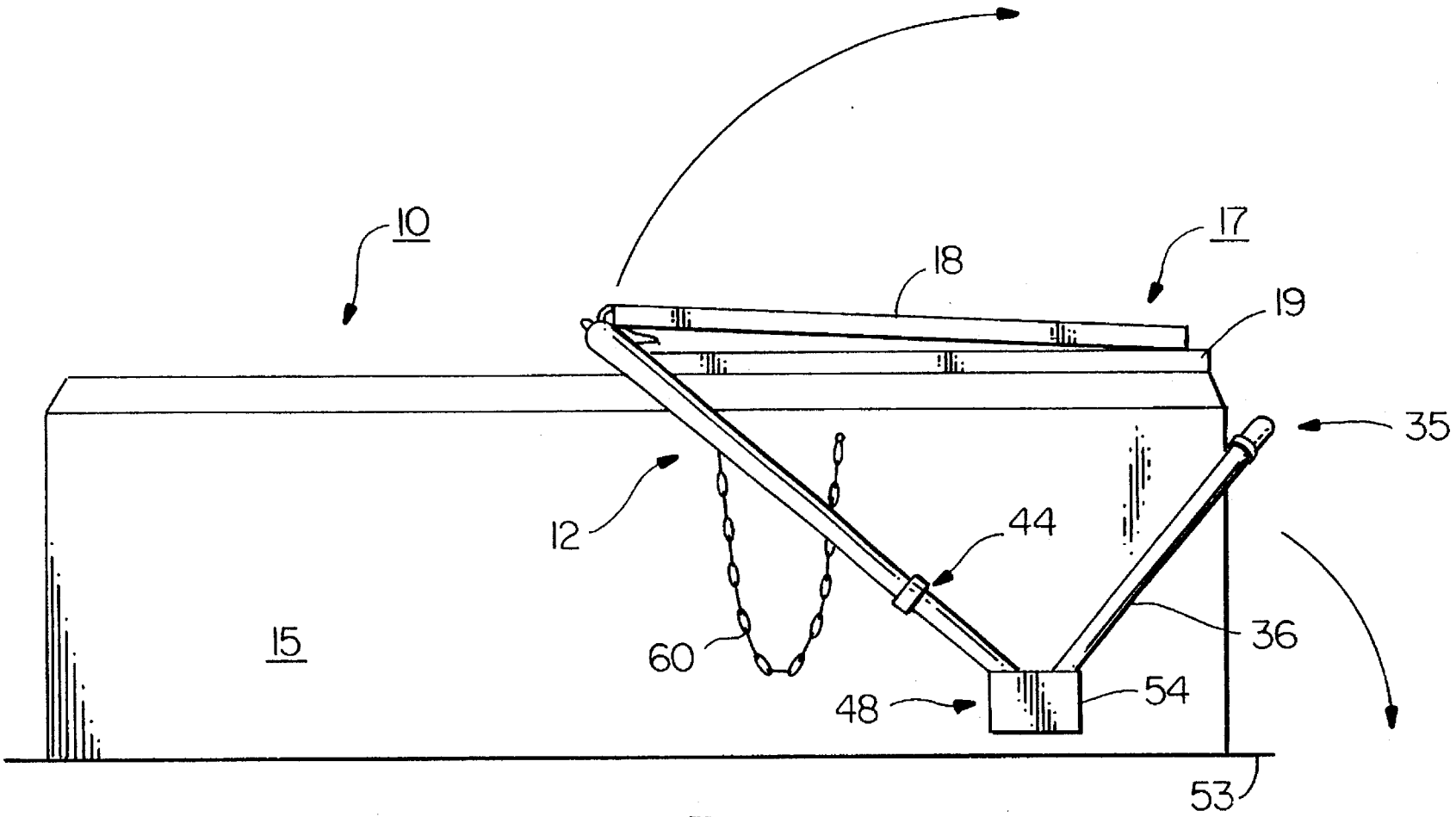
FIG. 13 is a partial perspective view showing the lifting frame of the present invention secured to one side wall of a spa.

FIG. 13 shows a further embodiment of the invention wherein brackets 54 secured by suitable fasteners to opposed side walls of the spa rather than the deck 53.

While this invention has been explained with reference to the structure disclosed herein, it is not confined to the details set forth and this invention is intended to cover any modifications and changes as may come within the scope of the following claims:

What is claimed is:

1. A spa cover lifting apparatus for a hinged spa cover that has two half sections cojoined by a hinge whereby the half sections are foldable one over the other, said apparatus including:

a pair of pivot units that are mountable adjacent to opposed side walls of a spa, a lifting arm rotatably mounted at a lower end in each of said pivot units, each arm including an inner and outer tubular section, that are slidably mounted one inside the other and a locking means for locking the tubular sections together at a desired position whereby the height of the lifting arms are adjustable, a stub shaft connected to an upper end of each lifting arm, said stub shafts being movable by said lifting arms to a first position adjacent to and parallel with the cover hinge and to a second position clear of an end wall of said spa whereby said cover half sections are foldable over said stub shafts when the lifting arms are in the first position and the arms are rotatable to the second position adjacent to said one end wall of said spa to remove said folded cover from said spa, and a U-shaped foot actuated lever means having an elongated base that passes adjacent to said one end wall of said spa and a pair of opposed legs, each leg being connected to the lower end of a respective one of said lifting arms to support the base in a elevated position when said arms are in said first position whereby depressing said base will help rotate the lifting arms from said first to said second position, said base further including second inner and outer sections slidably mounted one inside the other and second locking means for locking said second inner and outer sections in a desired position whereby the width of said base can be adjusted.

2. The spa cover lifting apparatus of claim 1 wherein said pivot units are mountable upon said opposed side walls of a spa.

3. The spa cover lifting apparatus of claim 1 wherein said pivot units are mountable upon a support surface adjacent to said opposed side walls.

4. The spa cover lifting apparatus of claim 1 wherein said elongated base of said lever means is arranged to rest upon a support surface adjacent to the one end wall of said spa when the lifting arms are in said second position.

5. The spa cover lifting apparatus of claim 1 wherein each stub shaft is mounted upon a hub and further includes an aligning pin mounted upon said hub that is arranged to pass beneath said hinge of said spa cover.

6. A spa cover lifting apparatus for lifting a hinged spa cover that has two half sections that are cojoined by a lateral hinge, whereby the half sections are foldable one over the other, said apparatus including a pair of pivot units that are mountable adjacent two side walls of a spa, a lifting arm rotatably mounted at a lower end in each pivot unit, a U-shaped member having an elongated base that passes adjacent to an end wall of said spa and a pair of opposed legs, each leg being connected to said lower end of one of said lifting arms, a stub shaft connected to an upper end of each lifting arm said stub shaft being movable by said lifting arm between a first position adjacent to and parallel with the hinge of a cover mounted upon a spa whereby said cover half sections are foldable over said stub shafts when the lifting arms are in said first position and to a second position clear of said end wall of said spa to remove said folded cover from said spa, a first adjusting means associated with each lifting arm for adjusting the height of said arm, a second adjusting means associated with the base of said U-shaped member whereby the length of said elongated base is adjustable, and an aligning pin mounted upon each lifting arm parallel with the stub shaft mounted thereon, said aligning pin being arranged to pass beneath said hinge whereby said hinge is positioned between the stub shaft and the pin.

* * * * *